US011168534B2

(12) United States Patent
El-Zefzafy et al.

(10) Patent No.: US 11,168,534 B2
(45) Date of Patent: Nov. 9, 2021

(54) DOWNHOLE CROSSFLOW CONTAINMENT TOOL

(71) Applicants: Saudi Arabian Oil Company, Dhahran (SA); Interwell Norway AS, Hafrsfjord (NO)

(72) Inventors: Ibrahim Mohamed El-Zefzafy, Udhailiyah (SA); Abdullah Ali Al-Ghamdi, Udhailiyah (SA); Mohammed Al-Suliman, Al-Qatif (SA); Kay Ivan Steinsheim Rovik, Vikhommer (NO)

(73) Assignees: Saudi Arabian Oil Company, Dhahran (SA); Interwell Norway AS, Hafrsfjord (NO)

( * ) Notice: Subject to any disclaimer, the term of this patent is extended or adjusted under 35 U.S.C. 154(b) by 125 days.

(21) Appl. No.: 16/675,699

(22) Filed: Nov. 6, 2019

(65) Prior Publication Data

US 2021/0131217 A1 May 6, 2021

(51) Int. Cl.
*E21B 33/12* (2006.01)
*E21B 34/06* (2006.01)

(52) U.S. Cl.
CPC ..... *E21B 33/12* (2013.01); *E21B 34/06* (2013.01); *E21B 2200/05* (2020.05)

(58) Field of Classification Search
CPC ..... E21B 33/12; E21B 34/06; E21B 2200/05
See application file for complete search history.

(56) References Cited

U.S. PATENT DOCUMENTS 3,399,037 A 8/1968 Eckfeldt
3,537,820 A 11/1970 Markant et al.
3,916,997 A 11/1975 Douglas et al.
(Continued)

FOREIGN PATENT DOCUMENTS

GB 2445678 7/2008
WO WO 9815711 4/1998
(Continued)

OTHER PUBLICATIONS

AlAjmi et al., "Profiling Downhole Casing Integrity Using Artificial Intelligence," Society of Petoleum Engineers, SPE-173422-MS, presented at the SPE Digital Energy Conference and Exhibition held in the Woodlands, Texas, Mar. 3-5, 2015, 13 pages.
(Continued)

*Primary Examiner* — Steven A Macdonald
(74) *Attorney, Agent, or Firm* — Fish & Richardson P.C.

(57) ABSTRACT

A well bridge plug assembly includes a sub body to be positioned in a well, the sub body including an internal fluid pathway extending from a downhole end of the sub body to an uphole end of the sub body. The sub body flows well fluid through the internal fluid pathway in an uphole direction from the downhole end toward the uphole end. A plug nose positioned at the downhole end of the sub body includes an aperture fluidly connected to the internal fluid pathway of the sub body. A flapper element in the internal fluid pathway moves between an open position and a closed position to selectively seal the internal fluid pathway from fluid flow, and a sealing element circumscribing a portion of the sub body selectively seals against a wall of a wellbore.

18 Claims, 6 Drawing Sheets

FIG. 3B

FIG. 3C

(56) References Cited

U.S. PATENT DOCUMENTS

| | | | | |
|---|---|---|---|---|
| 4,424,864 | A | 1/1984 | Logan | |
| 4,434,233 | A | 2/1984 | Bzdula | |
| 4,801,551 | A | 1/1989 | Byers et al. | |
| 5,343,956 | A * | 9/1994 | Coronado | E21B 23/06 166/123 |
| 5,497,321 | A | 3/1996 | Ramakrishnan et al. | |
| 5,504,009 | A | 4/1996 | Ohmi et al. | |
| 5,668,369 | A | 9/1997 | Oraby | |
| 5,678,635 | A | 10/1997 | Dunlap et al. | |
| 5,896,926 | A | 4/1999 | Hama | |
| 5,954,137 | A * | 9/1999 | Coronado | E21B 33/127 166/387 |
| 6,195,092 | B1 | 2/2001 | Dhond et al. | |
| 6,250,393 | B1 * | 6/2001 | Mackenzie | E21B 23/14 166/380 |
| 6,725,934 | B2 * | 4/2004 | Coronado | E21B 33/1208 166/313 |
| 7,513,311 | B2 | 4/2009 | Gramstand et al. | |
| 7,654,334 | B2 | 2/2010 | Manson | |
| 8,268,629 | B2 | 9/2012 | Coleman et al. | |
| 8,838,390 | B1 | 9/2014 | Selman et al. | |
| 2002/0092654 | A1 * | 7/2002 | Coronado | E21B 43/105 166/369 |
| 2006/0163467 | A1 | 7/2006 | Raghuraman | |
| 2007/0203681 | A1 | 8/2007 | Eyvazzadeh et al. | |
| 2007/0257684 | A1 | 11/2007 | Essich | |
| 2011/0040501 | A1 | 2/2011 | Martin | |
| 2012/0114089 | A1 | 5/2012 | Potyrailo et al. | |
| 2012/0201929 | A1 | 8/2012 | Guy et al. | |
| 2013/0328579 | A1 | 12/2013 | Whitehead et al. | |
| 2015/0129197 | A1 | 5/2015 | Andieychuk et al. | |
| 2016/0069147 | A1 | 3/2016 | Brown | |
| 2016/0334343 | A1 | 11/2016 | Hurlimann | |
| 2019/0153825 | A1 * | 5/2019 | Bourgneuf | E21B 43/26 |
| 2020/0263520 | A1 * | 8/2020 | Frosell | E21B 43/12 |

FOREIGN PATENT DOCUMENTS

| | | |
|---|---|---|
| WO | 2010012093 | 2/2010 |
| WO | 2016022069 | 2/2016 |
| WO | 2016124735 | 8/2016 |
| WO | WO 2019182764 | 9/2019 |

OTHER PUBLICATIONS

Al-Ajmi et al., "Risk Based Statistical Approach to Predict Casing Leaks," SPE-183948-MS, presented at the SPE Middle East Oil and Gas Show and Conference, Manama, Kingdom of Bahrain, Mar. 6-9, 2017, 19 pages.

Al-Mulhim et al., "Integrated Production Logging Approach for Successful Leak Detection Between Two Formations: A Case Study," SPE-174835-MS, Society of Petroleum Engineers, SPE Annual Technical Conference and Exhibition, Houston, Texas, Sep. 28-30, 2015, 15 pages.

Al-Sheri, A. et al.; "Successfule Optimization of Utilizing Multiphasing Flow Meters (MPFMs) for Multiple Wells with a Wide Range of Fluid Properties in South Ghawar"; SPE International; May 19, 2013, 10 pages.

Bilhartz, "A standardized Method of Monitoring Water Quality in Sub-Surface Injection System", Society of Petroleum Engineers, SPE1793, Copyright 1967, 11 pages.

Capelie, "Water-Analysis Diagrams—Kansas Oil-Field Brines", Apr. 1956, pp. 238-248, 11 pages.

Das, "Preventing Leaks through RUL Prediction Modeling: Casing Integrity in HP/HT Environment," SPE-184417-MS, Society of Petroleum Engineers, SPE Health, Safety, Security, Environment and Social Responsibility Conference, North America, New Orleasns, Louisiana, Apr. 18-20, 2017, 9 pages.

Guven et al., "Case Study: Surface-controlled Formation Isolation Valves and Their Application as a Barrier for Temporary Well Suspension," OTC 23997, presented at the Offshore Technology Conference on May 6-9, 2013, 7 pages.

Hwang and Elsinger, "Detecting Production Tubing Leak by Time Resolved Geochemical Analysis of Oils," SPE 29478, Society of Petroleum Engineers, presented at the Production Operations Symposium, Oklahoma City, OK, Apr. 2-4, 1995, 13 pages.

Interwell Serving Every Well, "Product Sheet: High Pressure High Temperature (HPHT) Bridge Plug," interwell.com, May 24, 2016, 2 pages.

Interwell Serving Every Well, "Product Sheet: High Temperature High Expansion Bridge Plug (THEX)," interwell.com, May 11, 2015, 2 pages.

Joarder et al., "Regression Analysis of Ground Water Quality Data of Sunamganj District, Bangladesh", International Journal of Environmental Research, ISSN: 1735-6865, pp. 291-296, Summer 2008, 6 pages.

Walker and Duncan, "Estimation of the probability of an event as a function of several independent variables," Biometrika vol. 54, 167-178, Jun. 1967, 14 pages.

Watfa, "Downhole Casing Corrosion Monitoring and Interpretation Techniques to Evaluate Corrosion in Multiple Casing Strings," SPE Production Engineering, Aug. 1991, 8 pages.

Yang et al., "Downhole Leak Detection: Introducing a New Wireline Array Noise Tool," SPE 194264-MS, presented at the SPE/ICoTA Well Intervention Conference and Exhibition, held in the Woodlands, Texas, Mar. 26-27, 2019, 16 pages.

Zaporozec, "Graphical Interpretation of Water-Quality Data", vol. 10, No. 2, Ground Water, Mar.-Apr. 1972, 12 pages, 12 pages.

PCT International Search Report and Written Opinion in International Appln. No. PCT/US2020/058858, dated Feb. 16, 2021, 12 pages.

* cited by examiner

DOWNHOLE CROSSFLOW CONTAINMENT TOOL

TECHNICAL FIELD

This disclosure relates to crossflow containment well tools, such as well bridge plugs.

BACKGROUND

In hydrocarbon production, a wellbore is drilled into a hydrocarbon-rich geological formation. After the wellbore is partially or completely drilled, a completion system is installed to secure the wellbore in preparation for production or injection. During production, hydrocarbons are extracted from the geological formation and flow uphole through the wellbore. Sometimes, water or other unwanted geological fluid also flows into the wellbore, called crossflow. Bridge plugs are often used to control fluid crossflow in a wellbore, for example, by isolating a section of the wellbore from fluid flow.

SUMMARY

This disclosure describes bridge plug assemblies, for example, that are disposed in a wellbore experiencing crossflow to seal and isolate a section of the wellbore.

In some aspects, a well bridge plug assembly includes a sub body configured to be positioned in a well, the sub body including an internal fluid pathway extending from a downhole end of the sub body to an uphole end of the sub body, and the sub body configured to flow well fluid through the internal fluid pathway in an uphole direction from the downhole end toward the uphole end. The assembly includes a plug nose positioned at the downhole end of the sub body, where the plug nose includes an aperture fluidly connected to the internal fluid pathway of the sub body. A flapper element disposed within the internal fluid pathway of the sub body is configured to move between an open position and a closed position to selectively seal the internal fluid pathway from fluid flow. A sealing element, circumscribing a portion of the sub body between the downhole end and the uphole end, is configured to selectively seal against a wall of a wellbore.

This, and other aspects, can include one or more of the following features. The sub body can include a shoulder extending into the internal fluid pathway, the shoulder configured to engage the flapper element in the closed position of the flapper element. The well bridge plug assembly can include a plurality of flapper elements including the first-mentioned flapper element and disposed within the internal fluid pathway, the plurality of flapper elements configured to move between the open position and the closed position to selectively seal the internal fluid pathway from fluid flow. The flapper element can pivotally connect to an inner wall of the sub body, the flapper element configured to pivot between the open position and the closed position. The well bridge plug assembly can include a plurality of apertures through the plug nose and including the first-mentioned aperture, the plurality of apertures fluidly connected to the internal fluid pathway of the sub body. The plurality of apertures can be disposed symmetrically about a front end of the plug nose. The plug nose can include a bull nose shape. The well bridge plug assembly can include an outlet aperture in the sub body at the uphole end of the sub body, the outlet aperture configured to direct the fluid flow in the internal fluid pathway to the wellbore uphole of the sealing element. The well bridge plug assembly can include a setting rod extending within the internal fluid pathway of the sub body and being selectively removable from the sub body, the setting rod configured to hold the flapper element in the open position to open the internal fluid pathway to fluid flow. The setting rod can connect to a well string disposed within the wellbore. The sealing element can include a sealing elastomer. The sealing element can include a packer element.

Certain aspects of the disclosure encompass a method for sealing a wellbore under crossflow. In a wellbore in which a well bridge plug assembly is disposed, the well bridge plug includes a sub body including an internal fluid pathway extending from a downhole end of the sub body to an uphole end of the sub body, a plug nose positioned at a downhole end of the sub body, a flapper element disposed within the internal fluid pathway of the sub body, and a sealing element. The plug nose includes an aperture fluidly connected to the internal fluid pathway of the sub body, the flapper element is configured to move between an open position and a closed position to selectively seal the internal fluid pathway from fluid flow, and the sealing element circumscribes a portion of the sub body between the downhole end and the uphole end. The method includes directing fluid flow through the aperture of the plug nose and through the internal fluid pathway of the sub body, engaging the sealing element with a wall of the wellbore, and sealing, with the sealing element, an annulus of the wellbore between the well bridge plug assembly and a wall of the wellbore from fluid flow.

This, and other aspects, can include one or more of the following features. The method can include directing the fluid flow in the internal fluid pathway through an outlet aperture in the sub body to the wellbore uphole of the sealing element, the outlet aperture positioned at the uphole end of the sub body. The method can include, in response to sealing the annulus of the wellbore with the sealing element, moving the flapper element to the closed position to seal the internal fluid pathway from fluid flow. Moving the flapper element to the closed position to seal the internal fluid pathway from fluid flow can include engaging the flapper element with a shoulder extending into the internal fluid pathway of the sub body. The well bridge plug assembly can include a removable setting rod extending within the internal fluid pathway of the sub body, and directing fluid flow into the aperture of the plug nose and through the internal fluid pathway of the sub body can include holding, with the removable setting rod, the flapper element in the open position to open the internal fluid pathway to fluid flow. The method can include, in response to sealing the annulus of the wellbore with the sealing element, removing the removable setting rod from the internal fluid pathway and moving the flapper element to the closed position to seal the internal fluid pathway from fluid flow.

Certain aspects of the disclosure include a crossflow well tool. The crossflow well tool includes a sub body configured to be positioned in a well, the sub body including an internal fluid pathway extending from an inlet aperture at a downhole end of the sub body to an outlet aperture at an uphole end of the sub body, where the sub body is configured to flow well fluid through the internal fluid pathway in an uphole direction from the inlet aperture toward the outlet aperture. The crossflow well tool further includes a flapper element disposed within the internal fluid pathway of the sub body, the flapper element configured to move between an open position and a closed position to selectively seal the internal fluid pathway from fluid flow, and a sealing element circumscribing a portion of the sub body between the downhole end and the uphole end, where the sealing element is configured to selectively seal against a wellbore wall.

This, and other aspects, can include one or more of the following features. The sub body can include a shoulder extending into the internal fluid pathway, and the flapper element can pivotally connect to an inner wall of the sub body. The flapper element can be configured to pivot between the open position and the closed position, and configured to engage the shoulder and seal the internal fluid pathway in the closed position of the flapper element.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
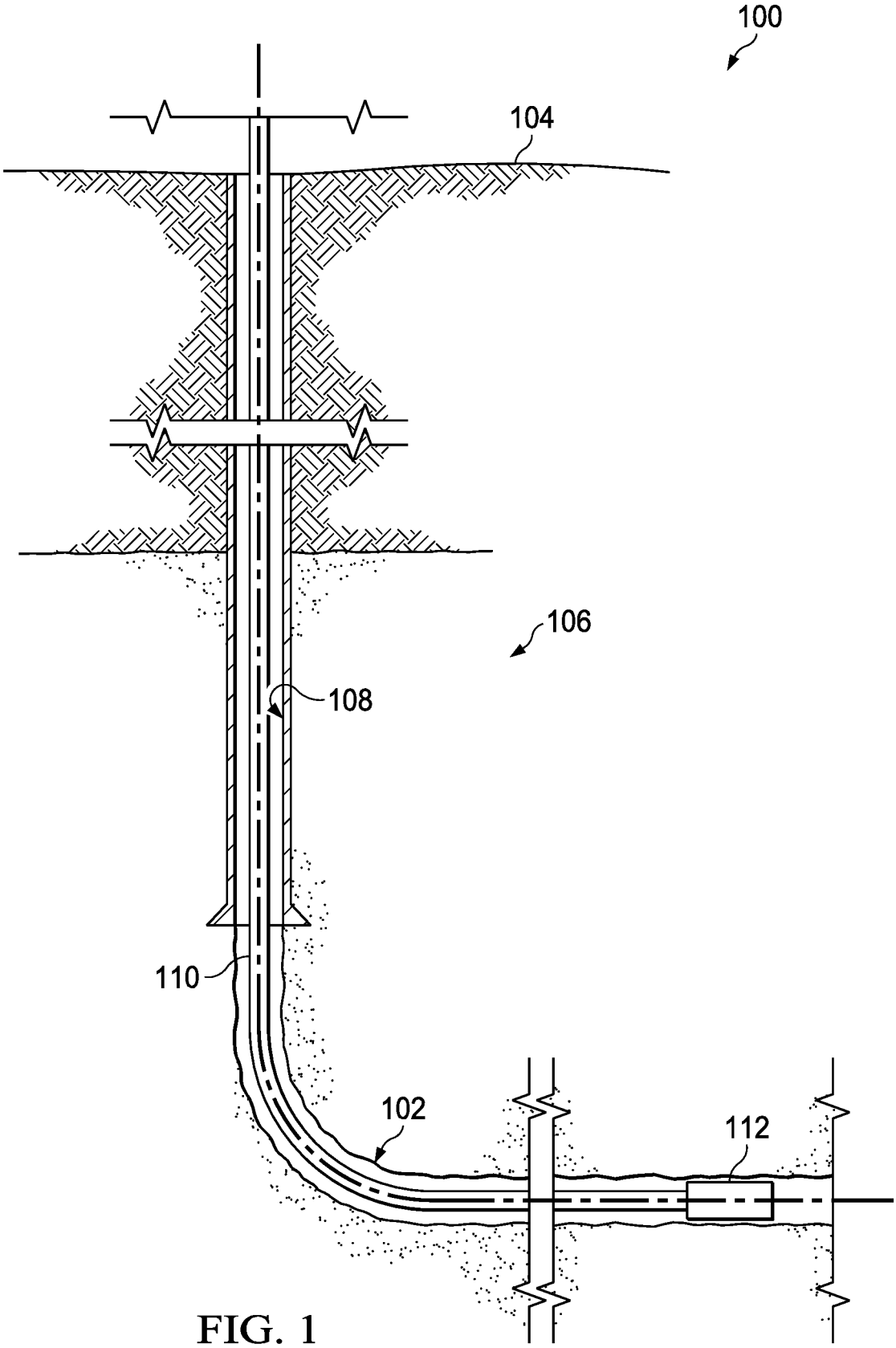
FIG. 1 is a schematic partial cross-sectional side view of an example well system.

This disclosure describes bridge plug assemblies for well systems, for example, to isolate a portion of a wellbore from fluid crossflow. In some wells, during well production operations, well fluid flow through the wellbore includes hydrocarbon flow and unwanted fluid flow, such as water. A bridge plug assembly can be run downhole and positioned in the wellbore at a location corresponding to high crossflow rates, such as over 10,000 barrels per day (bbl./day). The bridge plug assembly plugs the wellbore to restrict, prevent, or otherwise control fluid flow through the wellbore from downhole of the bridge plug assembly to uphole of the bridge plug assembly. In some implementations, water or other fluid infiltration exists in a wellbore further downhole in the wellbore than hydrocarbon flow, such that blocking the water or other fluid infiltration in the wellbore with a bridge plug reduces crossflow uphole of the bridge plug. A well bridge plug assembly installed in the wellbore can restrict water or other fluid crossflow from flowing uphole past the bridge plug assembly.

Some well bridge plug assemblies include a close-ended nose to prevent fluid flow through the bridge plug assembly, or include an internal flow pathway equipped with a back pressure valve (BPV) that allows certain well fluid flow through the bridge plug assembly. The back pressure valve can include flapper type valves, typically installed at the bottom of bridge plug system, and is utilized to seal off pressure. In wellbores with high fluid crossflow rates, for example, between 10,000 and 30,000 bbl./day, some well bridge plugs cannot perfect a sufficient seal to a wall of the wellbore (for example, an inner wall of a wellbore casing or inner wall of the wellbore) to plug the wellbore. For example, crossflow rates can be substantially high enough such that the volume and pressure of the fluid flowing across a packer sealing element of the bridge plug assembly prevents or reduces a sufficient seal between the packer sealing element and the wall of the wellbore. The well bridge plug assemblies described in this disclosure include a selectively sealable internal fluid pathway through a sub body of the well bridge plug, such that well fluid flowing through the internal fluid pathway provides an alternative pathway for well fluid to flow other than between the sealing element and the wall of the wellbore. This alternative pathway reduces a pressure of the well fluid acting on the sealing element during an expansion or sealing operation of the sealing element in order to perfect a sufficient seal between the sealing element and the wall of the wellbore. Also, the internal fluid pathway can be selectively closed following the engagement and sealing of the sealing element with the wall of the wellbore to close the internal fluid pathway from fluid flow, thereby isolating (substantially or completely) fluid downhole of the well bridge plug assembly from flowing uphole beyond the bridge plug assembly. The selectively sealable internal fluid pathway allows fluid flow through the well bridge plug to reduce a fluid pressure on the sealing element during a sealing operation while also being operable to close the internal fluid pathway from fluid flow, for example, after the sealing operation of the sealing element is complete.

FIG. 1 is a schematic partial cross-sectional side view of an example well system 100 that includes a substantially cylindrical wellbore 102 extending from a surface 104 downward into the Earth into one or more subterranean zones of interest 106 (one shown). The well system 100 includes a horizontal well, with the wellbore 102 extending substantially vertically from the surface 104 to the subterranean zone 106, and turning to a horizontal configuration in the subterranean zone 106. The concepts herein, however, are applicable to many different configurations of wells, including vertical, horizontal, slanted, or otherwise deviated wells. The well system includes a liner or casing 108 defined by lengths of tubing lining a portion of the wellbore 102 extending from the surface 104 into the Earth. The casing 108 is shown as extending only partially down the wellbore 102 and into the subterranean zone 106, with the horizontal portion of the wellbore 102 shown as open-hole (for example, without a liner or casing); however, the casing 108 can extend further into the wellbore 102 or end further uphole in the wellbore 102 than what is shown schematically in FIG. 1. A well string 110 is shown as having been lowered from the surface 104 into the wellbore 102. In some instances, the well string 110 is a series of jointed lengths of tubing coupled end-to-end or a continuous (or, not jointed) coiled tubing. The well string 110 can make up a production string, drill string, or other well string used during the lifetime of a well system. In the example well system 100 of FIG. 1, the well string 110 includes a well bridge plug assembly 112. The well bridge plug assembly 112 is shown in FIG. 1 at a bottommost, downhole end of the well string 110. However, the location of the well bridge plug assembly 112 can vary on the well string 110, and more than one well bridge plug assembly 112 can be distributed along the well string 110. For example, a well bridge plug assembly can be positioned at an intermediate location between a tophole end and a bottomhole end of the well string 110.

Figure 2A:
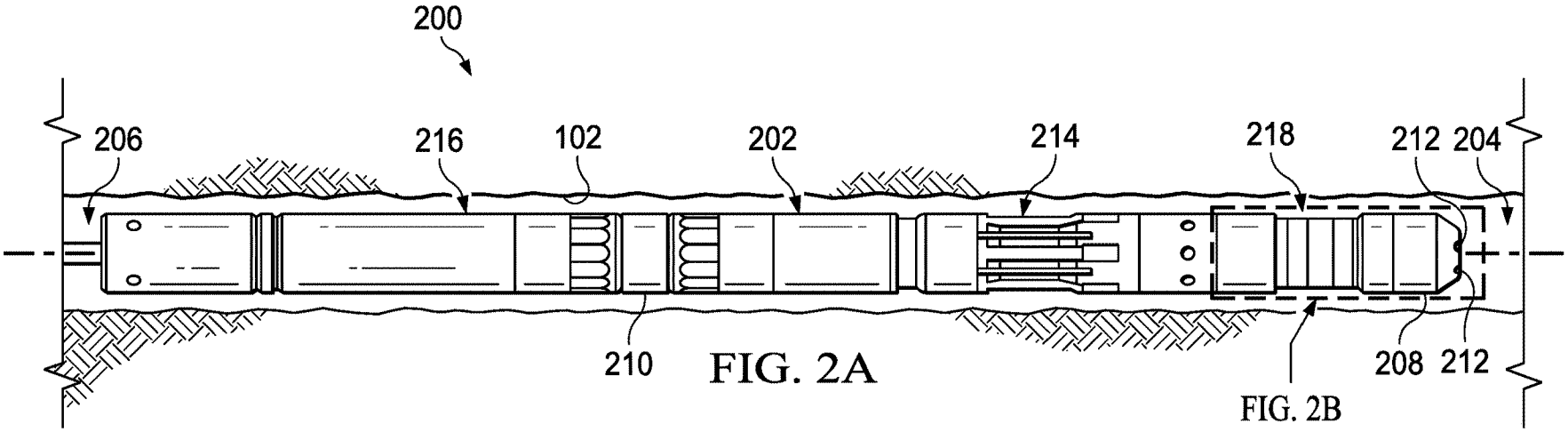
FIG. 2A is a schematic side view of an example bridge plug assembly in a wellbore.

FIG. 2A is a schematic side view of an example bridge plug assembly 200 that can be used in the well bridge plug assembly 112 of FIG. 1. The example bridge plug assembly 200 is shown in FIG. 2A as positioned in the wellbore 102, and includes a sub body 202, for example, with a downhole end 204 positioned further downhole in the wellbore 102 than an uphole end 206 of the sub body 202 opposite the downhole end 204. The sub body 202 is generally cylindrical, for example, to traverse the generally cylindrical wellbore 102. An internal fluid pathway (not shown), described in more detail later, extends through the sub body 202 from the downhole end 204 to the uphole end 206 to selectively flow fluid, such as well fluid in the wellbore 102, through the internal fluid pathway in an uphole direction from the downhole end 204 to the uphole end 206.

The example bridge plug assembly 200 also includes a plug nose 208 positioned at the downhole end 204 of the sub body 202, and a sealing element 210 circumscribing a portion of the sub body 202 between the downhole end 204 and the uphole end 206. The plug nose 208 is attached (for example, by any means including fastened, threaded, or otherwise coupled) to the sub body 202, or the plug nose 208 can be integral to the sub body 202. In the example bridge plug assembly 200, the plug nose 208 is directly located beneath (for example, directly downhole of) the dual back pressure valve (DBPV) 218. The plug nose 208 includes an aperture 212 fluidly connected to the internal fluid pathway of the sub body 202, for example, to allow fluid flow from the wellbore 102 downhole of the bridge plug assembly 200 into the internal fluid pathway. The dual back pressure valve (DBPV) 218 is depicted as a dual flapper check valve including two flapper elements 306, and is designed to minimize flow restriction in the intended flow direction and to prevent reverse flow and seal off pressure.

Figure 2B:
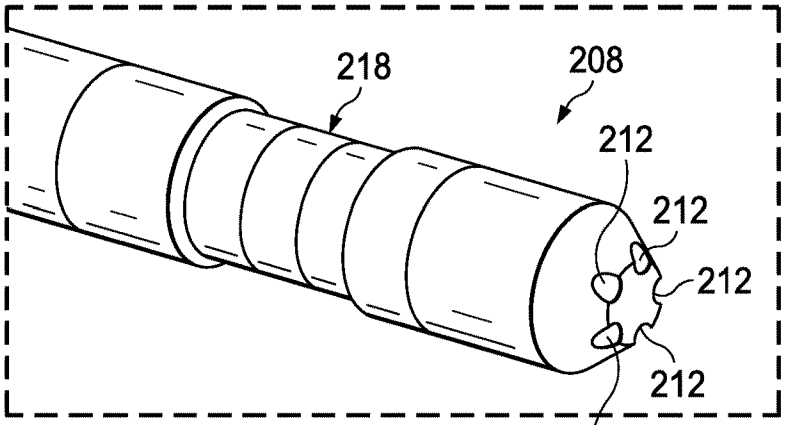
FIG. 2B is a schematic perspective view of an example plug nose of the example bridge plug assembly of FIG. 2A.

FIG. 2B is a schematic perspective view of the example plug nose 208 of the example bridge plug assembly of FIG. 2A. The example plug nose 208 is shown in FIG. 2B as having multiple apertures 212, in particular, five apertures 212 disposed symmetrically about a central longitudinal axis of the plug nose 208. However, the plug nose 208 can have a different number or pattern of apertures 212 that connect to the internal fluid pathway. For example, the plug nose 208 can include one, two, three, four, five, or six or more apertures 212, which can be disposed symmetrically or asymmetrically about the face of the plug nose 208. In some instances, when the plug nose 208 is integral to the sub body 202, the downhole end 204 of the sub body 202 includes the one or more apertures 212. The example plug nose 208 can take a variety of shapes, such as rounded, pointed, bull nosed, or another shape.

The sealing element 210 selectively seals against a wall of the wellbore 102, such as an open hole section of the wellbore wall or a wall of a casing. For example, the sealing element 210 extends or expands radially outward to engage and seal against the wall of the wellbore 102. In some implementations, the sealing element 210 is activated by dropping a setting ball and pumping it down to a ball seat formed in part of the hydraulic running tool above the plug. The sealing element 210 acts to plug the wellbore annulus, which is the space between an outer surface 216 of the sub body 202 and the wall of the wellbore 102, from fluid flow. The sealing element 210 can include a sealing elastomer, and can take a variety of forms. For example, the sealing element 210 can include a packer element, such as an inflatable packer, swellable packer, elastomeric packer, a combination of these, or other packer elements. In certain implementations, the bridge plug assembly 200 includes slips 214 configured to radially expand toward the wall of the wellbore 102. The slips 214 can include movable arm elements that radially expand toward the wall of the wellbore 102 and engage (for example, contact) the wall of the wellbore 102. Well fluid, mechanical activation, or other aspects of the well bridge plug 200 can activate the slips 214 to move from a radially inward position where the slips 214 substantially align with the outer surface 216 of the sub body 202 to the radially outward position where the slips 214 can engage the wall of the wellbore 102. The slips 214 centrally position the bridge plug assembly 200 within the wellbore 102 along (substantially or exactly) a central longitudinal axis of the wellbore 102, for example, to position the sub body 202 during the sealing operation of the sealing element 210. The slips 214 are shown in FIG. 2A as positioned along the sub body 202 downhole of the sealing element 210; however, the position of the slips 214 can vary. For example, the slips 214 can be closer to the sealing element 210, farther from the sealing element 210, uphole of the sealing element 210, or in another location along the sub body 202. In FIG. 2A, both the sealing element 210 and the slips 214 are shown in a radially retracted position, where sealing element 210 and the slips 214 substantially align with the outer surface 216 of the sub body 202. The sealing element 210, the slips 214, or both, can be oriented differently, for example, such that the radially retracted position of the sealing element 210, slips 214, or both, constitute a position that is radially inward or radially outward from the outer surface 216 of the sub body 202.

Figure 3A:
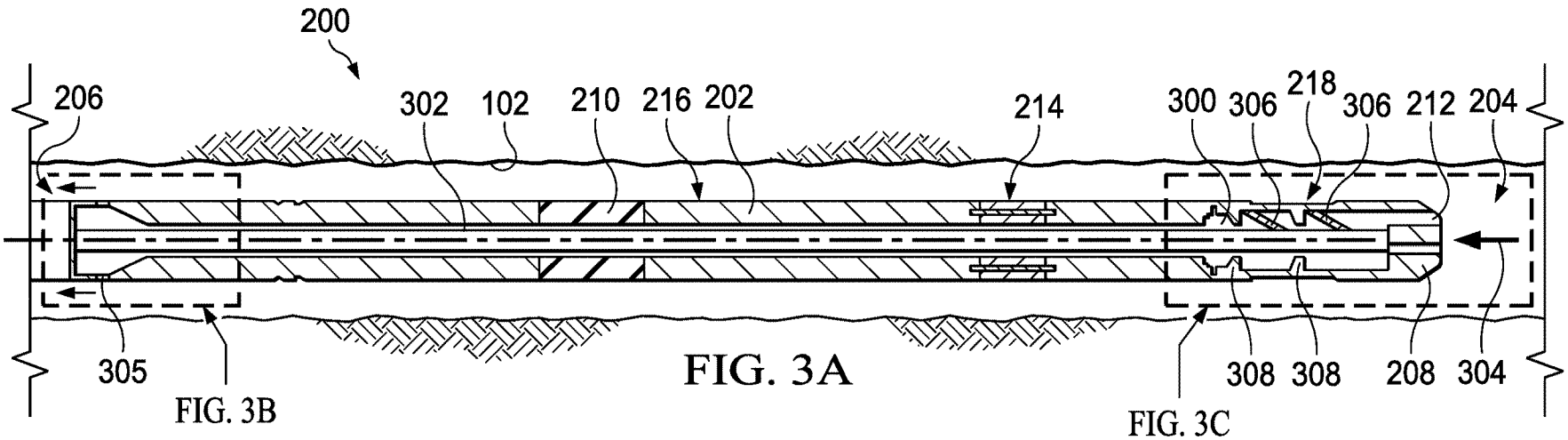
FIG. 3A is a schematic cross-sectional side view of an example bridge plug assembly in a wellbore.

FIG. 3A is a schematic cross-sectional side view of the example bridge plug assembly 200 in the wellbore 102. As shown in FIG. 3A, the sub body 202 includes the internal fluid pathway 300 extending from the downhole end 204 (for example, at the aperture(s) 212 of the plug nose 208) to the uphole end 206 of the sub body 202. Also, a removable setting rod 302 of the well bridge plug assembly 200 is shown as extending from the uphole end 206 to the downhole end 204, for example, within the internal fluid pathway 300. The setting rod 302 is removable such that the setting rod 302 can be removed, for example, following a sealing operation of the sealing element 210 where the bridge plug assembly 200 is set in place in the wellbore 102 with the sealing element 210, the slips 214, or both. The setting rod 302 can connect to a well string, such as well string 110 of FIG. 1, disposed within the wellbore 102.

Figure 3C:
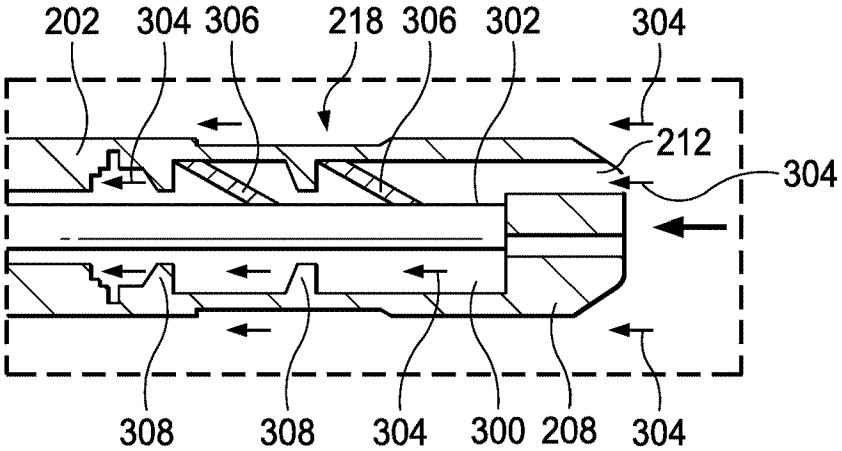
FIGS. 3B and 3C are partial schematic cross-sectional side views of an uphole end and a downhole end, respectively, of the example bridge plug assembly of FIG. 3A.
Figure 3B:
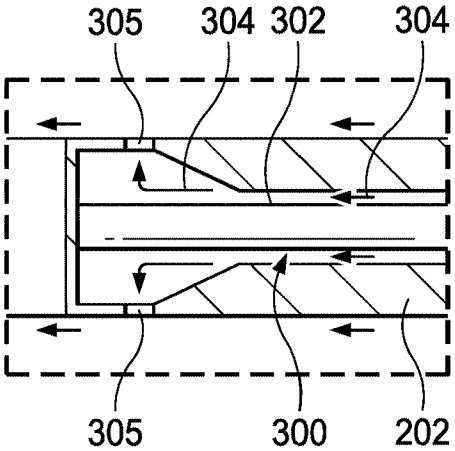

FIGS. 3B and 3C are partial schematic cross-sectional side views of the uphole end 206 and the downhole end 204, respectively, of the example bridge plug assembly 200 of FIG. 3A. FIGS. 3B and 3C show flow of fluid through the wellbore 102 from downhole of to uphole of the bridge plug assembly 200. The flow of fluid is indicated by arrows 304, where the fluid flows partly through the bridge plug assembly 200 (via the internal fluid pathway 300) and partly through the annulus between the bridge plug assembly 200 and the wellbore wall. For example, the bridge plug assembly 200 directs fluid through an inlet aperture, such as the aperture 212 of the plug nose 208, through the internal fluid pathway 300 of the sub body 202, and out to the wellbore 102 uphole of the bridge plug assembly 200 through one or more outlet apertures 305 in the sub body 202. The outlet aperture(s) 305 are positioned at an uphole end of the internal fluid pathway 300 at the uphole end 206 of the sub body 202.

Referring to FIGS. 3A to 3C, the example bridge plug assembly 200 includes flapper elements 306 (two shown) disposed within the internal fluid pathway 300, for example, as part of the dual back pressure valve (DBPV) 218. The flapper elements 306 pivotally connect to an inner wall of the sub body 202, and are configured to move, or pivot, between an open position (as shown in FIGS. 3A and 3C) and a closed position (refer to FIGS. 5A and 5C), described later. For example, the setting rod 302 holds the flapper elements 306 in the open position when engaged with the sub body 202 to open the internal fluid pathway 300 to fluid flow, whereas the flapper elements 306 can move to the closed position when the setting rod 302 is disengaged and removed from the sub body 202 to close the internal fluid pathway 300 to fluid flow. The flapper elements 306 selectively seal the internal fluid pathway 300 from fluid flow, for example, in the uphole direction. In the open position of the flapper elements 306, well fluid is free to flow through the internal fluid pathway 300, such as in the uphole direction from the downhole end 204 to the uphole end 206. In the closed position of the flapper elements 306, well fluid is blocked from flow through the internal fluid pathway 300.

FIGS. 3A and 3C show two flapper elements 306 in the internal fluid pathway 300 proximate to the plug nose 208. However, the number and location of the flapper elements 306 can vary. For example, the example bridge plug assembly 200 can include one or more flapper elements, and the one or more flapper elements can be positioned anywhere along the internal fluid pathway 300.

In some implementations, the sub body 202 includes a shoulder 308 corresponding to each flapper element 306. In the example bridge plug assembly of FIGS. 3A-3C, two shoulders 308 correspond to the two flapper elements 306. The shoulder(s) 308 extends into the internal fluid pathway 300 and engages the flapper element 306 in the closed position of the flapper element 306. For example, the shoulder 308 can include a lip edge extending radially inward into the internal fluid pathway 300, and the shoulder 308 acts as a seat for the flapper element 306 to engage and seal against, closing the internal fluid pathway 300 from fluid flow. In some examples, the flapper elements 306 have a substantially circular cross-section and the respective shoulders 308 have a lip edge with a corresponding circular cross-section. An outer diameter of the flapper elements 306 can be the same or larger than an inner diameter of the lip edge of the shoulder 308 to close and seal the internal fluid pathway 300 in the closed position of the flapper elements 306. The flapper elements 306 can pivot together or separately between the open position, as indicated in FIGS. 3A and 3C, and the closed position, described later with respect to FIGS. 5A and 5C.

Figure 4A:
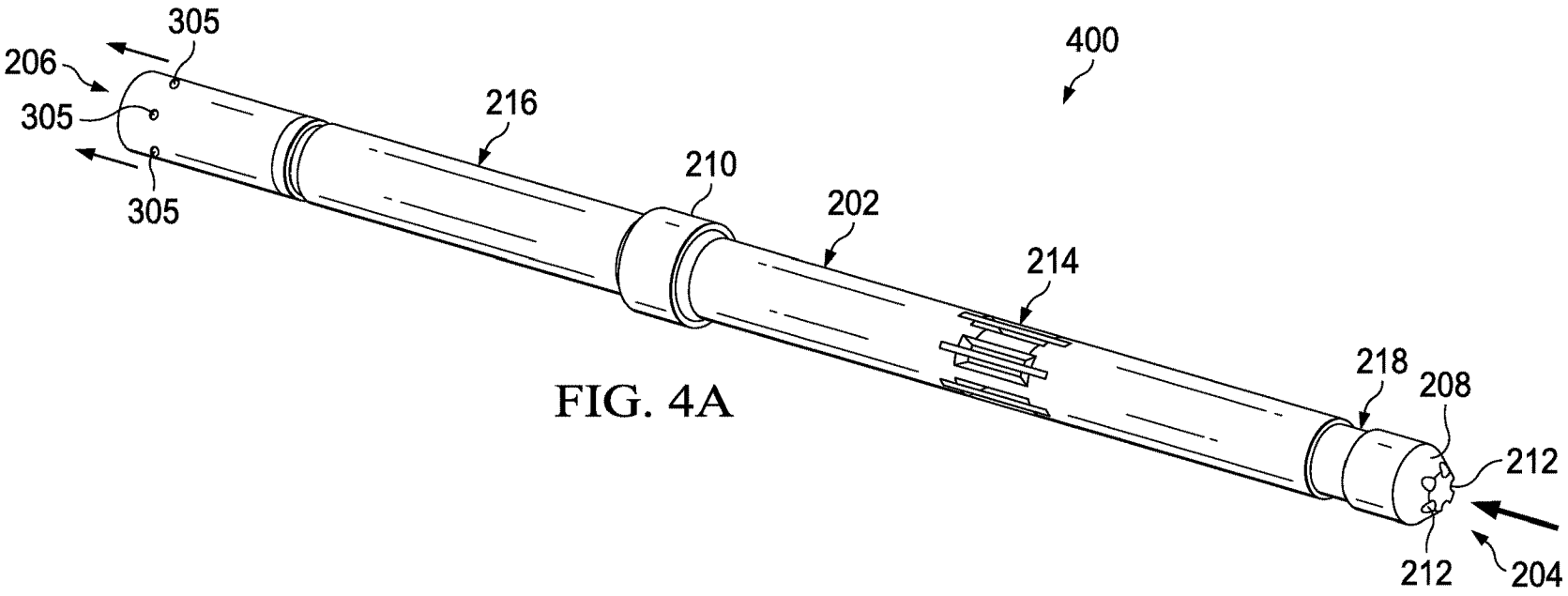
FIGS. 4A and 4B are a schematic perspective view and a schematic cross-sectional side view, respectively, of an example bridge plug assembly in a wellbore.
Figure 4B:
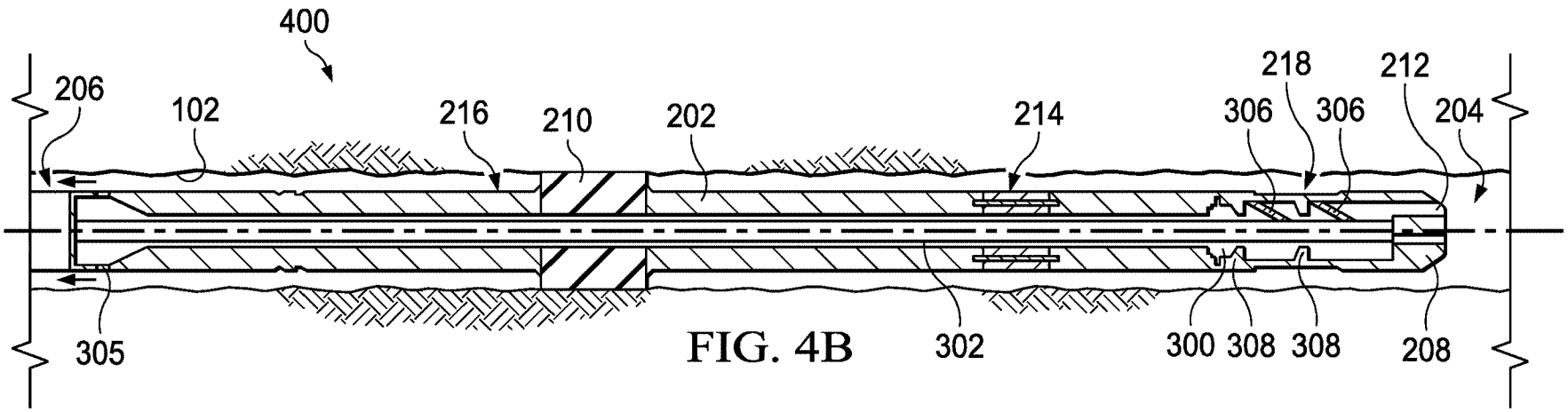

FIGS. 4A and 4B are a schematic perspective view and a schematic cross-sectional side view, respectively, of an example bridge plug assembly 400 in the wellbore 102. The example bridge plug assembly 400 is like the example bridge plug assembly 200 of FIGS. 2A-3C, except the sealing element 210 and the slips 214 are shown in radially outward, expanded positions. In the example bridge plug assembly 400 of FIGS. 4A and 4B, well fluid flows through the open internal fluid pathway 300 as the sealing element 210 engages and seals against the wall of the wellbore 102. The internal fluid pathway 300 directs at least a portion of the fluid flow from downhole of the bridge plug assembly 400 through the internal fluid pathway 300 to an open bore area of the wellbore 102 uphole of the bridge plug assembly 400. The internal fluid pathway 300 directs a portion of the fluid flow through the bridge plug assembly 400 to reduce the impact (for example, upward force, velocities, differential pressure, or a combination of these) of fluid crossflow on the sealing element 210 as the sealing element 210 fully expands to engage and seal against the wellbore wall. The fluid that flows through the internal fluid pathway 300 would otherwise impact the sealing element 210, for example, which would increase the chance of an imperfect seal between the sealing element 210 and the wellbore wall if the internal fluid pathway 300 was not open to flow.

Figure 5A:
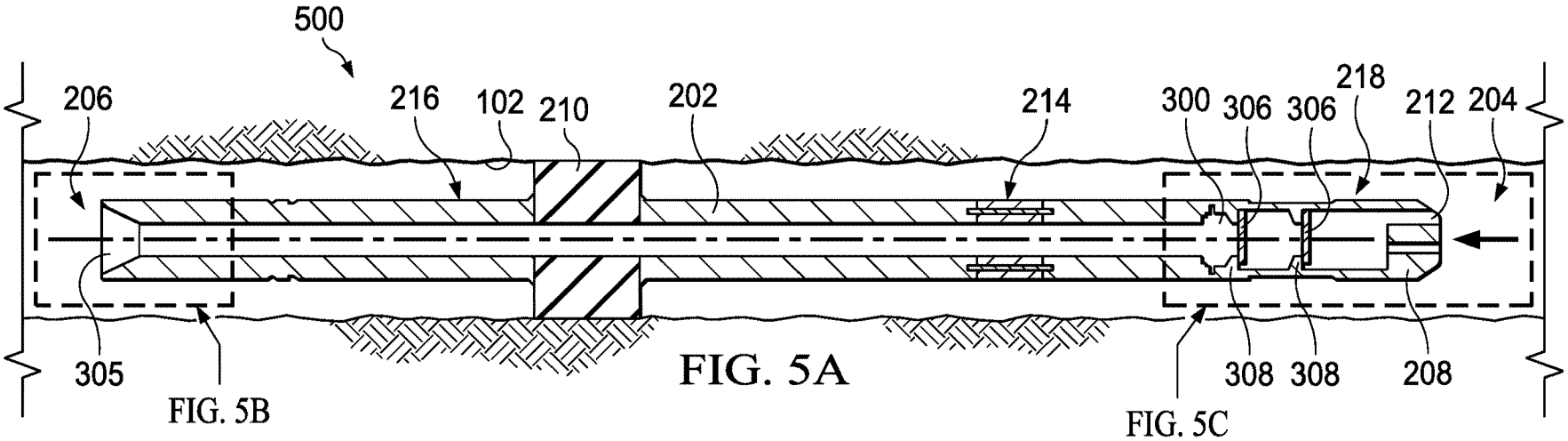
FIG. 5A is a schematic cross-sectional side view of an example bridge plug assembly in a wellbore.
Figure 5C:
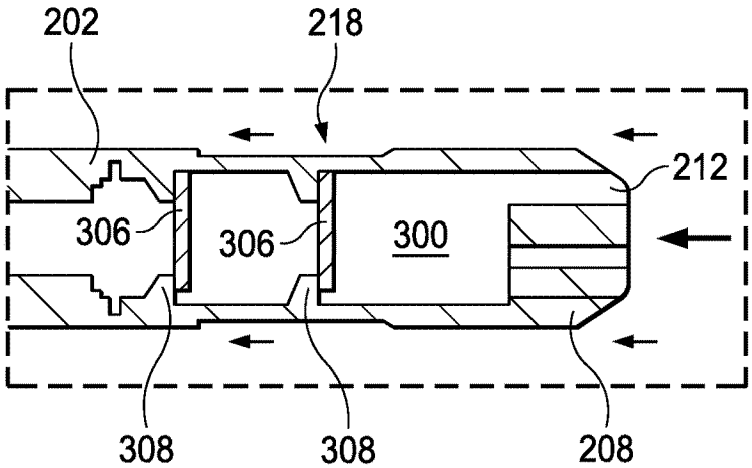
FIGS. 5B and 5C are partial schematic cross-sectional side views of an uphole end and a downhole end, respectively, of the example bridge plug assembly of FIG. 5A.
Figure 5B:
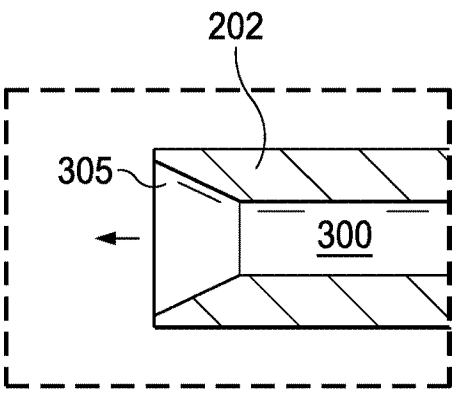

FIG. 5A is a schematic cross-sectional side view of an example bridge plug assembly 500 in the wellbore 102. The example bridge plug assembly 500 is like the example bridge plug assembly 200 of FIGS. 2A-3C and the example bridge plug assembly 400 of FIGS. 4A-4C, except the setting rod is removed and the flapper elements 306 are in the closed position. FIGS. 5B and 5C are partial schematic cross-sectional side views of the uphole end 206 and the downhole end 204, respectively, of the example bridge plug assembly 500 of FIG. 5A. As discussed earlier, shoulders 308 extend into the internal fluid pathway 300 and engage the flapper element 306 in the closed position of the flapper element 306, as shown in FIGS. 5A and 5C. For example, the shoulders 308 include a lip edge extending radially inward into the internal fluid pathway 300, and act as a seat for the flapper elements 306. The flapper elements 306 pivot from the open position (as shown in FIGS. 3A and 3C) to the closed position to engage and seal against the shoulders 308, closing the internal fluid pathway 300 from fluid flow uphole through the internal fluid pathway 300. The flapper elements 306 can pivot together or separately between the open position, as indicated in FIGS. 3A and 3C, and the closed position, as indicated in FIGS. 5A and 5C. In some implementations, a pressure within the wellbore 102 downhole of the bridge plug assembly 500 acts against a downhole surface of the flapper element(s) 306 in the closed position, biasing the flapper element 306 to remain in the closed position.

Figure 6:
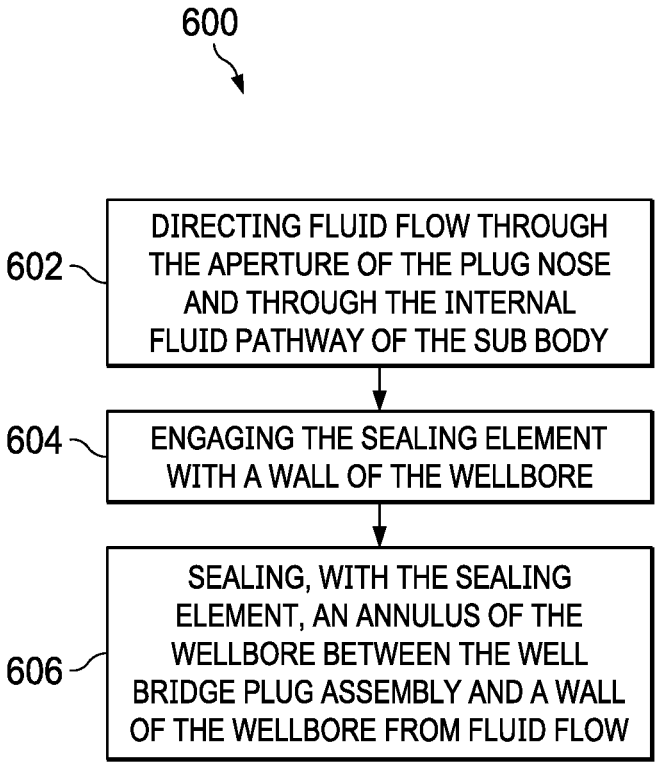
FIG. 6 is a flowchart describing an example method for sealing a wellbore under crossflow.

FIG. 6 is a flowchart describing an example method 600 for sealing a wellbore under crossflow, for example, performed by the example well bridge plug assembly 200, 400, or 500. An example well bridge plug assembly disposed in a wellbore can include a sub body having an internal fluid pathway extending from a downhole end of the sub body to an uphole end of the sub body, a plug nose positioned at a downhole end of the sub body, the plug nose including an aperture fluidly connected to the internal fluid pathway of the sub body, a flapper element disposed within the internal fluid pathway of the sub body, where the flapper element can move between an open position and a closed position to selectively seal the internal fluid pathway from fluid flow, and a sealing element circumscribing a portion of the sub body between the downhole end and the uphole end. At 602, fluid flow is directed through the aperture of the plug nose and through the internal fluid pathway of the sub body. At 604, the sealing element engages with a wall of the wellbore. At 606, the sealing element seals an annulus of the wellbore between the well bridge plug assembly and a wall of the wellbore from fluid flow. In some instances, the flapper element moves to the closed position to seal the internal fluid pathway from fluid flow in response to the sealing element sealing the annulus. For example, a removable setting rod extending within the internal fluid pathway of the sub body can hold the flapper element in the open position to open the internal fluid pathway to fluid flow while the sealing element engages and seals with the wellbore wall, and, in response to the sealing element sealing the annulus of the wellbore, the setting rod can be removed from the internal fluid pathway to allow the flapper element to move to the closed position, sealing the internal fluid pathway from fluid flow.

A number of implementations have been described. Nevertheless, it will be understood that various modifications may be made without departing from the spirit and scope of the disclosure.

What is claimed is:

1. A well bridge plug assembly comprising:

a sub body configured to be positioned in a well, the sub body comprising an internal fluid pathway extending from a downhole end of the sub body to an uphole end of the sub body, the sub body configured to flow well fluid through the internal fluid pathway in an uphole direction from the downhole end toward the uphole end;

a plug nose positioned at the downhole end of the sub body, the plug nose comprising an aperture fluidly connected to the internal fluid pathway of the sub body;

a flapper element disposed within the internal fluid pathway of the sub body, the flapper element configured to move between an open position and a closed position to selectively seal the internal fluid pathway from fluid flow in the uphole direction, wherein the flapper element pivotally connects to an inner wall of the sub body, the flapper element extends downhole from the connection to the inner wall in the open position, and the flapper element configured to pivot in the uphole direction from the open position to the closed position; and a sealing element circumscribing a portion of the sub body between the downhole end and the uphole end, the sealing element configured to selectively seal against a wall of a wellbore.

2. The well bridge plug assembly of claim 1, wherein the sub body comprises a shoulder extending into the internal fluid pathway, the shoulder configured to engage the flapper element in the closed position of the flapper element.

3. The well bridge plug assembly of claim 1, comprising a plurality of flapper elements including the first-mentioned flapper element and disposed within the internal fluid pathway, the plurality of flapper elements configured to move between the open position and the closed position to selectively seal the internal fluid pathway from fluid flow.

4. The well bridge plug assembly of claim 1, comprising a plurality of apertures through the plug nose and including the first-mentioned aperture, the plurality of apertures fluidly connected to the internal fluid pathway of the sub body.

5. The well bridge plug assembly of claim 4, wherein the plurality of apertures are disposed symmetrically about a front end of the plug nose.

6. The well bridge plug assembly of claim 1, wherein the plug nose comprises a bull nose shape.

7. The well bridge plug assembly of claim 1, comprising an outlet aperture in the sub body at the uphole end of the sub body, the outlet aperture configured to direct the fluid flow in the internal fluid pathway to the wellbore uphole of the sealing element.

8. The well bridge plug assembly of claim 1, comprising a setting rod extending within the internal fluid pathway of the sub body and being selectively removable from the sub body, the setting rod configured to hold the flapper element in the open position to open the internal fluid pathway to fluid flow, and the setting rod configured to be removed from the sub body to allow movement of the flapper element to the closed position to seal the internal fluid pathway from fluid flow in the uphole direction.

9. The well bridge plug assembly of claim 8, wherein the setting rod connects to a well string disposed within the wellbore.

10. The well bridge plug assembly of claim 1, wherein the sealing element comprises a sealing elastomer.

11. The well bridge plug assembly of claim 1, wherein the sealing element comprises a packer element.

12. A method of sealing a wellbore under crossflow, the method comprising:

in a wellbore in which a well bridge plug assembly is disposed, the well bridge plug assembly comprising:

a sub body comprising an internal fluid pathway extending from a downhole end of the sub body to an uphole end of the sub body;

a plug nose positioned at a downhole end of the sub body, the plug nose comprising an aperture fluidly connected to the internal fluid pathway of the sub body;

a flapper element disposed within the internal fluid pathway of the sub body, the flapper element configured to move between an open position and a closed position to selectively seal the internal fluid pathway from fluid flow, wherein the flapper element pivotally connects to an inner wall of the sub body, the flapper element extends downhole from the connection to the inner wall in the open position, and the flapper element configured to pivot in the uphole direction from the open position to the closed position; and a sealing element circumscribing a portion of the sub body between the downhole end and the uphole end;

directing fluid flow through the aperture of the plug nose and through the internal fluid pathway of the sub body;

engaging the sealing element with a wall of the wellbore; and sealing, with the sealing element, an annulus of the wellbore between the well bridge plug assembly and a wall of the wellbore from fluid flow.

13. The method of claim 12, comprising directing the fluid flow in the internal fluid pathway through an outlet aperture in the sub body to the wellbore uphole of the sealing element, the outlet aperture positioned at the uphole end of the sub body.

14. The method of claim 12, further comprising, after sealing the annulus of the wellbore with the sealing element, moving the flapper element to the closed position to seal the internal fluid pathway from fluid flow.

15. The method of claim 14, wherein moving the flapper element to the closed position to seal the internal fluid pathway from fluid flow comprises engaging the flapper element with a shoulder extending into the internal fluid pathway of the sub body.

16. The method of claim 12, wherein the well bridge plug assembly comprises a removable setting rod extending within the internal fluid pathway of the sub body, and directing fluid flow into the aperture of the plug nose and through the internal fluid pathway of the sub body comprises holding, with the removable setting rod, the flapper element in the open position to open the internal fluid pathway to fluid flow.

17. The method of claim 16, further comprising, after sealing the annulus of the wellbore with the sealing element, removing the removable setting rod from the internal fluid pathway and moving the flapper element to the closed position to seal the internal fluid pathway from fluid flow.

18. A method of sealing a wellbore under crossflow, the method comprising:

in a wellbore in which a well bridge plug assembly is disposed, the well bridge plug assembly comprising:

a sub body comprising an internal fluid pathway extending from a downhole end of the sub body to an uphole end of the sub body;

a plug nose positioned at a downhole end of the sub body, the plug nose comprising an aperture fluidly connected to the internal fluid pathway of the sub body;

a flapper element disposed within the internal fluid pathway of the sub body, the flapper element configured to pivot between an open position and a closed position to selectively seal the internal fluid pathway from fluid flow, wherein the flapper element pivotally connects to an inner wall of the sub body, the flapper element extends downhole from the connection to the inner wall in the open position, and the flapper element configured to pivot in the uphole direction from the open position to the closed position;

a sealing element circumscribing a portion of the sub body between the downhole end and the uphole end; and a removable setting rod extending within the internal fluid pathway of the sub body;

directing fluid flow through the aperture of the plug nose and through the internal fluid pathway of the sub body, wherein the directing comprises holding, with the removable setting rod, the flapper element in the open position to open the internal fluid pathway to fluid flow;

engaging the sealing element with a wall of the wellbore;

sealing, with the sealing element, an annulus of the wellbore between the well bridge plug assembly and a wall of the wellbore from fluid flow; and in response to sealing the annulus of the wellbore with the sealing element, removing the removable setting rod from the internal fluid pathway and moving the flapper element to the closed position to seal the internal fluid pathway from fluid flow.

* * * * *